US010486226B2

(12) United States Patent
Quach et al.

(10) Patent No.: US 10,486,226 B2
(45) Date of Patent: Nov. 26, 2019

(54) CORE FOR MANUFACTURING A TURBOMACHINE BLADE

(71) Applicant: Safran Aircraft Engines, Paris (FR)

(72) Inventors: Daniel Quach, Moissy-Cramayel (FR); Pascal Francis Patrick Gomez, Moissy-Cramayel (FR); Coralie Cinthia Guerard, Moissy-Cramayel (FR); Jean-Claude Marcel Auguste Hanny, Moissy-Cramayel (FR); Patrick Emilien Paul Emile Huchin, Moissy-Cramayel (FR); Joseph Toussaint Tami Lizuzu, Moissy-Cramayel (FR); Matthieu Jean Luc Vollebregt, Moissy-Cramayel (FR); Vincent Marc Herb, Moissy-Cramayel (FR); Laetitia Person, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 15/963,371

(22) Filed: Apr. 26, 2018

(65) Prior Publication Data

US 2018/0311722 A1 Nov. 1, 2018

(30) Foreign Application Priority Data

Apr. 28, 2017 (FR) ..... 17 53817

(51) Int. Cl.

| | |
|---|---|
| ***B22C 9/10*** | (2006.01) |
| ***F01D 5/14*** | (2006.01) |
| ***B22C 9/04*** | (2006.01) |

(52) U.S. Cl.

CPC ..... *B22C 9/103* (2013.01); *B22C 9/04* (2013.01); *F01D 5/147* (2013.01); *F05D 2230/211* (2013.01)

(58) Field of Classification Search

CPC ..... B22C 9/04; B22C 9/103; B22C 21/14

See application file for complete search history.

(56) References Cited

U.S. PATENT DOCUMENTS

| | | | |
|---|---|---|---|
| 5,394,932 | A | 3/1995 | Carozza et al. |
| 5,820,774 | A | 10/1998 | Dietrich |
| 2015/0053365 | A1 | 2/2015 | Mueller et al. |

FOREIGN PATENT DOCUMENTS

| | | | |
|---|---|---|---|
| FR | 2 874 186 | A1 | 2/2006 |
| FR | 2 875 425 | A1 | 3/2006 |
| FR | 3 037 829 | A1 | 12/2016 |
| WO | WO 2005/113210 | A2 | 12/2005 |
| WO | WO 2013/167847 | A2 | 11/2013 |
| WO | WO 2015/026535 | A1 | 2/2015 |

*Primary Examiner* — Kevin P Kerns
*Assistant Examiner* — Steven S Ha
(74) *Attorney, Agent, or Firm* — Blank Rome LLP

(57) ABSTRACT

A core used in the manufacture, by lost-wax casting, of a turbomachine blade, includes a main element and at least one first secondary element, each including a functional part and a non-functional part. The non-functional part of the main element and the non-functional part of the at least one first secondary element are assembled and shaped so as to cooperate with each other by sliding in a longitudinal direction extending between the base and the top of a blade and by rotating around the longitudinal direction.

10 Claims, 1 Drawing Sheet

CORE FOR MANUFACTURING A TURBOMACHINE BLADE

CROSS-REFERENCE TO RELATED APPLICATIONS

This application claims the benefit of French Patent Application No. 1753817, filed Apr. 28, 2017, the contents of which are incorporated herein by reference.

TECHNICAL FIELD

The present invention relates to the field of turbomachine blades and more specifically to blades obtained by pouring a molten alloy into a mould according to the lost-wax casting technique.

BACKGROUND

Traditionally, the lost-wax casting technique consists in first creating a model made of wax, or any other material that can easily be eliminated at a later stage, of the part to be produced. This model includes an internal part forming a ceramic core, which represents the cavities that one wants to see appear inside the blade. The wax model is then dipped several times in slurries consisting of a suspension of ceramic particles to make a shell mould, by carrying out so-called stuccoing and drying procedures.

The shell mould is then dewaxed, which is a procedure in which the wax, or the material of which the original model is made, is eliminated from the shell. Once the wax has been eliminated, a ceramic mould is obtained whose cavity reproduces all of the blade's shapes and which still contains the ceramic core intended to generate the internal cavities of the blade. The mould is then subjected to a high-temperature heat treatment or "firing", which provides it with the required mechanical properties.

The shell mould is then ready to manufacture the metal part by casting. After checking the internal and external integrity of the shell mould, the following step consists in pouring a molten metal, which fills the gaps between the internal wall of the shell mould and the core, and then solidifying it. In the field of lost-wax casting, there are currently several solidifying techniques, thus several pouring techniques according to the nature of the alloy and to the expected properties of the part resulting from the casting. This may be directional solidification of columnar structure (DS), directional solidification of single crystals (SX) or equiaxed solidification (EX).

After casting the alloy, the shell is broken using a shake-out procedure. In another step, the ceramic core, which has remained enclosed in the blade obtained, is eliminated chemically. The metal blade obtained is then subjected to finishing procedures used to obtain the finished part.

Examples of how to produce turbine blades using the lost-wax casting technique are provided in the applicant's patent applications FR2875425 and FR2874186.

To form the wax model of the blade, a tooling outfit, or wax injection mould, is used in which the core is placed and then the liquid wax is injected through a channel provided for this purpose.

The search for improved engine performance implies among others more efficient cooling of the turbine blades located downstream of the combustion chamber. In order to meet this requirement, it is necessary to form more elaborate internal cavities inside the blades to circulate the cooling fluid. A distinctive feature of these blades is that they have several metal walls and thus require the production of increasingly complex ceramic cores.

Due to the complexity of the cooling cavities to be formed with their separating walls and their layout, the core is made of several parts that are assembled and bonded. The basic cores are generally connected one to another at the base and at the top. The goal is indeed to control the thickness of the walls and partitions formed when casting. The assembly must enable the core to support the stresses to which it is subjected during the wax injection, dewaxing and casting steps.

The various parts of the core must therefore be placed in a very precise manner one with respect to another inside the wax injection mould and it must be guaranteed that the relative positions of the various parts of the mould are retained. The retention of the various parts of the core as proposed in the current technique consists in achieving a firm connection between these core parts or elements and the ceramic shell. While such a retention can in theory be used to guarantee precise relative positioning of the various core elements, it has been observed that pouring the molten metal leads to a significant thermal expansion of the core elements, which in turn leads to the deformation of some of these elements due to the static connection one with respect to another of the elements making up the core, which contributes to increasing the scrap rate of the blades. In critical cases, one of the core elements may even break, which obviously leads to the scrapping of the blade obtained but also to the manufacturing of a new core, which is both costly and time-consuming.

SUMMARY

The invention more particularly aims at providing a simple, efficient and cost-effective solution to the problems of the prior art disclosed above.

To this end, it proposes a core used in the manufacture, by lost-wax casting, of a turbomachine blade, extending along a longitudinal direction between a base and a head, and comprising one main element and at least one first secondary element each including a functional part and a non-functional part, characterized in that the non-functional part of the main element and the non-functional part of said at least one first secondary element are assembled and shaped so as to cooperate with one another by sliding in the longitudinal direction and rotating around this longitudinal direction.

According to the invention, the connection between the main element and the first secondary element of the core allows for relative movement of the core elements one with respect to another through longitudinal sliding and through rotation. More specifically, when the main element is fastened to the ceramic shell, the first secondary core may expand longitudinally and rotationally in its non-functional part. Deformation and breakage of the core can thus be limited, which reduces the scrap rate of the blades at the end of a lost-wax casting procedure.

Moreover, using non-functional parts of the core elements avoids having to modify its functional parts. Dimensioning these functional parts may indeed be difficult to achieve and a modification of their shapes for any other reason than those related to the final shape of the blade is not desirable. The non-functional parts are shaped at one longitudinal end of the core, preferably at its base.

The term "functional" used in reference to the core indicates whether the part thus qualified can produce a face of the final geometry of the blade. A non-functional part thus refers to an area of the core element that has no impact on the final geometry of the part.

The longitudinal direction corresponds to a direction extending from the base of the blade to the top of the blade, this longitudinal direction being substantially perpendicular to the axis of rotation of the turbomachine.

According to another characteristic of the invention, the sliding motion is a linear sliding motion, i.e. along a line, more specifically a straight line, the sliding motion thus being linear rectilinear. The main element of the core and the first secondary element of the core are thus placed and guided in their motion one with respect to another at the base along a rectilinear line of the first secondary element sliding along the plane of the main element. This also makes it possible to have an isostatic and non-statically indeterminate positioning of the first secondary element on the main element.

The linear, more specifically rectilinear, sliding mode differs from the sliding of a surface on another surface in that it prevents excessive mechanical stresses from being exerted on the first secondary element and the main element, which would generate buckling, deformation or even breakage of the core elements.

In order to allow differential expansions between the first secondary element of the core and the shell as well as absolute expansions of said two parts of the core with respect to the shell mould, an expansion gap may be provided between the shell mould and the first secondary element. This expansion gap may be achieved by inserting a film of varnish between the first secondary element and a boss of the shell mould. It is understood that the film of varnish will be eliminated during the shell mould dewaxing and firing procedure giving rise to a free space forming a gap between the first secondary element and the shell mould.

Advantageously, the combination of the expansion gap and of the aforementioned linear guiding advantageously limits the risks of core breakage thus allowing for the blade manufacturing method to be optimized.

Said non-functional part of said at least one secondary element may include a rod engaged by sliding into the first groove of the non-functional part of the main element. The linear rectilinear guiding may then be achieved in the contact area of the rod with the bottom of the groove. The film of varnish is then deposited on a portion of the rod's face arranged opposite the bottom of the first groove.

The first groove may include two lateral sidewalls that are spaced increasingly further apart from one another in the direction of the outlet of the groove. The use of such sidewalls facilitates the centring of the rod in the groove. When the cross section of the rod is substantially circular, the linear support can be achieved with a plane bottom surface of the groove.

In one embodiment, the core includes a second secondary element of which a non-functional part comprises a rod engaged by longitudinally sliding into a second groove of the non-functional part of the main element.

The rod of the first secondary element and the rod of the second secondary element are, for example, arranged symmetrically to each other with respect to a line extending longitudinally, the first groove and the second groove opening into opposite directions according to a direction that is perpendicular to the longitudinal direction.

It also relates to a method for manufacturing a blade by means of a core such as described above, wherein the non-functional part of the main element of the core is retained in a wax injection mould by an anchoring means on a wall of the mould.

BRIEF DESCRIPTION OF THE DRAWINGS

The invention will be better understood, and other details, advantages and characteristics of the invention will appear upon reading the following description given by way of a non-restrictive example while referring to the following figures.

DETAILED DESCRIPTION

Figure 1:
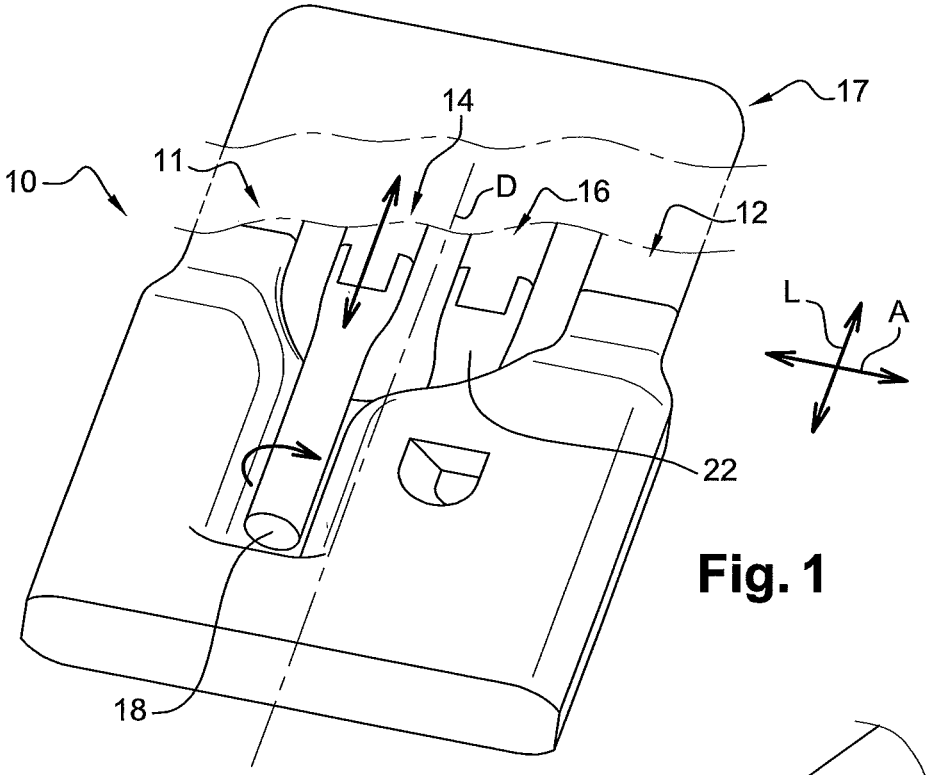
FIG. 1 is a perspective diagrammatic view of a lower end of a core according to the invention.

We first refer to FIG. 1, which shows a lower end of the core 10 according to the invention comprising a main element 12 and two secondary elements, i.e. a first secondary element 14 and a second secondary element 16. FIG. 1 only shows the non-functional parts of the elements constituting the core 10, these non-functional parts being arranged at a longitudinal end of the core 10 (double arrow L). As mentioned above, a non-functional part of the core 10 is a part that is not involved in the final geometry of the part during the lost-wax casting process.

Figure 3:
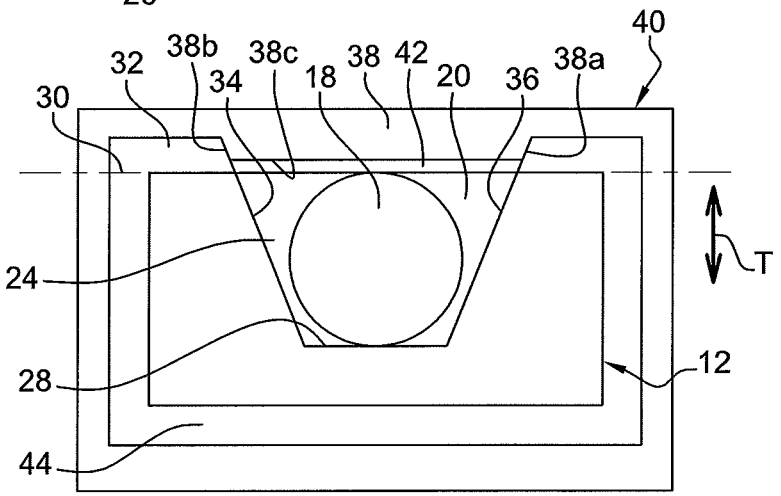
FIG. 3 is a diagrammatic view along a cutting plane line of the assembly of a rod of a core element in a groove of another core element.

The core 10 extends along three directions that are perpendicular two by two, one longitudinal direction L corresponding on the final blade to the longitudinal direction L connecting the base to the top of the blade, one axial direction A (FIG. 1) corresponding on the final blade to the upstream/downstream direction and one transverse direction T crossing the pressure and suction faces of the blade (FIG. 3). The core includes a head 17 on FIG. 1 and a base 11, which is shown alone in FIG. 1.

The main element 12 of the core 10 is intended to form, in its functional part (not shown), a central cavity of the blade and the first and second secondary elements 14, 16 are intended to form, in their functional parts (not shown), cavities in the pressure and suction walls of the blade.

Figure 2:
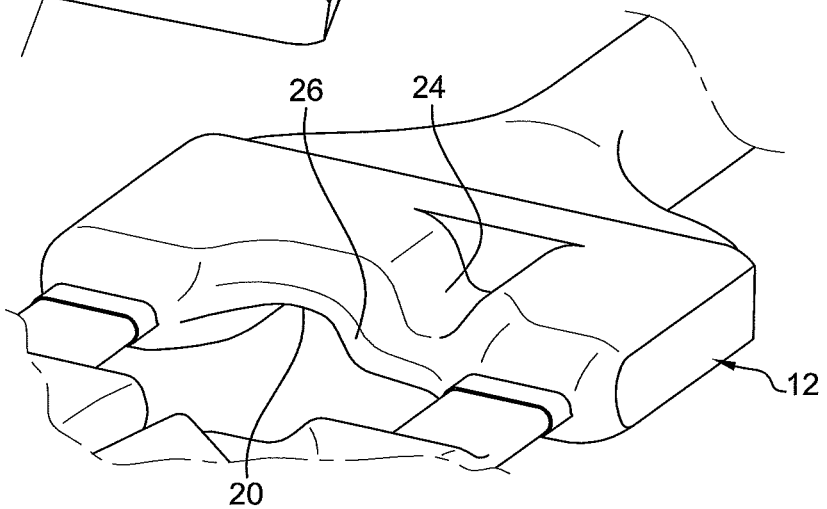
FIG. 2 is a perspective diagrammatic view of the main element of the core according to the invention.

As can clearly be seen in FIG. 1, the non-functional part of the first secondary element 14 includes a rod or finger 18 extending substantially longitudinally and which is accommodated in a substantially longitudinal first groove 20 or notch of the non-functional part of the main element 12 (FIGS. 1 and 2). Likewise, the second secondary element 16 includes in its non-functional part a rod 22 extending substantially longitudinally and which is accommodated in a substantially longitudinal second groove 24 or notch of the non-functional part of the main element 12 (FIGS. 1 and 2). The invention also covers embodiments in which the main element 12 of the core 10 only comprises a single groove associated with a single secondary element of the core.

As shown in FIG. 2, the first groove 20 and the second groove 24 open into opposite directions according to a direction that is perpendicular (double arrow T) to the longitudinal direction L, i.e. along the transverse direction T. The rod 18 of the first secondary element 12 and the rod 22 of the second secondary element 16 are symmetrical to each other with respect to a line D extending longitudinally L.

The first groove 20 and the second groove 24 are separated from one another by a veil 26 of material of the main element 12 of the core, this veil 26 being obliquely inclined with respect to a first plane containing the longitudinal direction L and the transverse direction T and a second plane containing the longitudinal direction L and the axial direction A.

According to the invention, the rod 18 of the first secondary element 14 is slidably mounted in the first groove 20 of the main element 12 of the core 10. Likewise, the rod 22 of the second secondary element 16 is slidably mounted in the second groove 24 of the main element 12 of the core 10. In addition, each of the grooves 20, 24 is so formed as to allow a degree of freedom in the rotation of the rods 18, 22 around the longitudinal axis L The rods 18, 22 have a circular shape and the bottom 28 of the grooves 20, 22 is plane so that the contact between a rod 18, 22 and the bottom 28 of a groove 20, 24 is a linear rectilinear contact, which makes it possible to achieve guiding along a rectilinear support of the first secondary element of the core and of the second secondary element of the core on the main element of the core without any statically indeterminate connection. In this way, the friction of the three parts of the core against one another is highly limited and relative expansion is possible.

In addition, each rod 18, 22 is so dimensioned that its diameter stays flush with the outlet plane 30 of the groove 20, 24 into which it is engaged. One can thus ensure linear contact between the shell 32 and the rod 18, 22 of each of the first 14 and second 16 secondary elements.

Each groove 20, 24 includes two opposite sidewalls 34, 36 connected to each other by the plane bottom wall 28. The two sidewalls 34, 36 of each groove 20, 24 are spaced increasingly further apart from one another in the direction of the outlet of the groove 20, 24. As can clearly be seen in FIG. 3, the width of the groove 20, 24 measured at the level of the bottom wall 28 is less than the diameter of the rod 18, 22.

As shown in FIG. 3, the shell mould includes a first internal boss 38 formed on an inner face of the mould 40 and is placed so as to clamp the rod 18 of the first secondary element 14 of the core 10 in the first notch 20 of the main element 12 of the core 10. Similarly, the mould 40 includes a second internal boss (not shown) formed on an inner face of the mould 40 and placed so as to clamp the rod 22 of the second secondary element 16 of the core 10 in the second notch 24 of the main element 12 of the core 10. It should be noted that the first 38 and second bosses are thus formed on opposite faces of the mould in the transverse direction T and cover the openings of the first 20 and second 24 notches. It is understood that there is wax in the area 44 separating the shell mould 40 from the core 10.

Each boss 38 includes two longitudinal sidewalls 38*a*, 38*b* obliquely inclined with respect to each other, converging one toward the other in the direction of the inside of mould 40 and connected one to another by a wall 38*c* for clamping the rods 18, 22 of the first and second secondary elements 14, 16 of the core 10 in the bottom of the notch 20, 24. The sidewalls 38*a*, 38*b* are preferably inclined at an angle ranging from 10° to 30° with respect to a plane containing the longitudinal direction A and the direction T, which is transverse to the longitudinal direction, and passing between both sidewalls 38*a*, 38*b*.

As can be clearly seen in FIG. 3, a film of varnish 42 is inserted between the rod 18, 22 of each of the non-functional part of the first secondary element 14 and of the non-functional part of the second secondary element 16 and the wall 38*c* of the opposite boss 38. It is understood that the film of varnish 42 will be eliminated during the shell mould dewaxing and firing procedure giving rise to a free space forming a gap between each of the first secondary element 14 and the second secondary element 22 and the shell mould 40. This free space forms a means of slidably retaining the non-functional second parts of the first 14 and second 16 secondary elements.

While the invention has been described with respect to a linear rectilinear and rotational sliding cooperation of a rod in a groove 20, 24, it is understood that these movements can be obtained in other ways, which are included in the scope of protection.

Thus, in another embodiment of the invention, the rod 18 of the first secondary element 14 and the rod 22 of the second secondary element 16 could have a shape that is other than circular, e.g. oval, and more generally be of a concave shape.

The invention claimed is:

1. A core used in manufacturing, by lost-wax casting, a turbomachine blade, comprising:

the core extending along a longitudinal direction between a base and a head, the core comprising one main element and a first secondary element, each including a functional part and a non-functional part, wherein the non-functional part of the main element and the non-functional part of said first secondary element are assembled and shaped so as to cooperate with one another by sliding in the longitudinal direction and rotating around the longitudinal direction.

2. The core of claim 1, wherein a sliding motion is a linear rectilinear sliding motion and the non-functional parts are formed at one longitudinal end of the core.

3. The core of claim 1, wherein said non-functional part of the first secondary element comprises a rod engaged by sliding into a first groove of the non-functional part of the main element.

4. The core of claim 3, wherein the first groove includes two lateral sidewalks that are spaced increasingly further apart from one another in a direction of an outlet of the groove.

5. The core of claim 4, wherein the sidewalk are connected to a substantially plane bottom wall.

6. The core of claim 3, wherein the rod has a substantially circular cross section.

7. The core of, claim 1, further comprising a second secondary element of which a non-functional part comprises a rod engaged by longitudinally sliding into a second groove of the non-functional part of the main element.

8. The core of claim 7, wherein the second groove is located on a face of the main element that is opposite a first groove of the non-functional part of the main element.

9. The core of claim 7, wherein the rod of the first secondary element and the rod of the second secondary element are symmetrical to each other with respect to a line extending longitudinally, a first groove of the non-functional part of the main element and the second groove opening into opposite directions according to a direction that is perpendicular to the longitudinal direction.

10. The core of claim 1, wherein a sliding motion is a linear rectilinear sliding motion and the non-functional parts are formed at the base of the core.

* * * * *